US008382007B2

(12) United States Patent
Sugiwara et al.

(10) Patent No.: US 8,382,007 B2
(45) Date of Patent: Feb. 26, 2013

(54) FUEL INJECTION VALVE

(75) Inventors: Satoshi Sugiwara, Kariya (JP); Tomonori Kamiya, Ichinomiya (JP)

(73) Assignee: Denso Corporation, Kariya (JP)

( * ) Notice: Subject to any disclaimer, the term of this patent is extended or adjusted under 35 U.S.C. 154(b) by 272 days.

(21) Appl. No.: 12/842,137

(22) Filed: Jul. 23, 2010

(65) Prior Publication Data

US 2011/0095102 A1 Apr. 28, 2011

(30) Foreign Application Priority Data

Oct. 23, 2009 (JP) ..... 2009-244498

(51) Int. Cl.
*F02M 41/16* (2006.01)

(52) U.S. Cl. ..... 239/96; 239/533.8; 239/585.1

(58) Field of Classification Search ..... 239/96, 239/585.1–585.5, 533.8
See application file for complete search history.

(56) References Cited

U.S. PATENT DOCUMENTS 6,648,248 B2 * 11/2003 Adachi et al. ..... 239/585.1

FOREIGN PATENT DOCUMENTS

| | | |
|---|---|---|
| JP | H9-032684 | 2/1997 |
| JP | 2002-147310 | 5/2002 |
| JP | P2003-021017 A | 1/2003 |
| JP | P2004-176656 A | 6/2004 |
| JP | P2005-155418 A | 6/2005 |
| JP | P2007-023969 A | 2/2007 |

OTHER PUBLICATIONS

Japanese Office Action dated Jan. 24, 2012, issued in corresponding Japanese Application No. 2009-244498 with English Translation.

* cited by examiner

*Primary Examiner* — Christopher Kim
(74) *Attorney, Agent, or Firm* — Nixon & Vanderhye PC

(57) ABSTRACT

A fuel injection valve includes a needle for opening or closing an injection hole. The needle moves in response to a fuel pressure in a control chamber. The fuel injection valve includes an electromagnetic valve which opens or closes a discharge passage for changing pressure in the control chamber to actuate the needle. A narrow part is provided in the discharge passage. The narrow part is formed to shorten a length along a flow direction. The shortened narrow part can suppress pulsations. Therefore, it is possible to accurately control injection quantity, since a variation of closing speed of the armature caused by the pulsations can be suppressed.

1 Claim, 5 Drawing Sheets

FUEL INJECTION VALVE

CROSS REFERENCE TO RELATED APPLICATION

This application is based on Japanese Patent Application No. 2009-244498 filed on Oct. 23, 2009, the contents of which are incorporated herein by reference in its entirety.

FIELD OF THE INVENTION

The present invention relates to a fuel injection valve which has a nozzle needle driven by changing pressure in a control chamber.

BACKGROUND OF THE INVENTION

A conventional fuel injection valve is provided with components such as a needle, a control chamber and an electromagnetic valve. The needle opens and closes an injection hole for injecting fuel to an internal combustion engine (engine). The control chamber is introduced with high-pressure fuel. The electromagnetic valve opens and closes a discharge passage which discharges fuel in the control chamber to an externally located low pressure area. When the electromagnetic valve closes the discharge passage, fuel in the control chamber urges the needle to close the injection hole. When the electromagnetic valve opens the discharge passage, fuel in the control chamber is discharged and permits the needle to open the injection hole. One of this kind of fuel injection valve is disclosed in JP2002-147310A.

The fuel injection valve includes a housing which is disposed next to the solenoid of the electromagnetic valve and is disposed on a side of the solenoid opposite to the needle. The housing includes a lower hole, an upper hole, and a communicating hole. The lower hole provides a part of the discharge passage. The upper hole is disposed in the downstream of the lower hole and provides a part of the discharge passage. The communicating hole provides a part of the discharge passage by communicating the lower hole and the upper hole. A spring which pushes and urges an armature and a movable member for a valve is arranged in the lower hole. A return pipe for leading fuel discharged from the control chamber to the low pressure area, e.g., a fuel tank is inserted in the upper hole. The armature is also arranged in the discharge passage.

The lower hole includes a bottom which works as a spring seat. For this reason, it is necessary to form an inner diameter of the communicating hole smaller than an outer diameter of the spring. For example, the inner diameter of the communicating hole may be formed substantially equal to the inner diameter of the spring.

SUMMARY OF THE INVENTION

In order to meet recent requirements for diesel engines, it is necessary to improve accuracy of injection quantity.

According to the conventional fuel injection valve, the upper hole is formed with a relatively short length in order to receive the return pipe. Therefore, it is necessary to lengthen the communicating hole. As a result, a ratio L/D becomes large, where L is a length of the communicating hole, and D is a diameter of the communicating hole. For this reason, a restricting effect in the communicating hole is adversely increased. As a result, at an upstream of the communicating hole in the discharge passage, pressure pulsations of fuel discharged from the control chamber becomes large.

If the pressure pulsations become large, the pressure pulsations may change pressure in a chamber accommodating the armature. For example, the pressure in the chamber may differ greatly depending on closing moment of the electromagnetic valve. As a result, a closing speed of the armature, which is a moving speed of the armature in a closing direction, is varied and fluctuated among injections. Therefore, there is a problem that an injection quantity can not be controlled with high accuracy.

It is an object of the present invention to provide a fuel injection valve which is capable of controlling the injection quantity accurately. It is another object of the present invention to provide a fuel injection valve which can suppress adverse effect caused by pressure pulsations of discharged fuel from the control chamber.

According to one embodiment of the present invention, a fuel injection valve is provided. The fuel injection valve has a first end and a second end axially distanced each other. The fuel injection valve comprises: a valve mechanism disposed on the first end, the valve mechanism including a nozzle defining an injection hole for injecting fuel and a needle for opening or closing the injection hole; a control chamber in which high-pressure fuel is introduced; and an electromagnetic valve which opens or closes a discharge passage for discharging fuel in the control chamber to a low pressure part, the electromagnetic valve being capable of changing pressure in the control chamber to actuate the needle.

The electromagnetic valve includes: a solenoid which defines a solenoid passage for providing a part of the discharge passage and generates electromagnetic force when being energized; a connector which receives a terminal connected to the solenoid; a housing which is disposed between the solenoid and the second end, defines a hole for providing a part of the discharge passage, and provides a shoulder end on which the connector is attached, which radially extends perpendicular to an axial direction of the fuel injection valve; an armature which is arranged in the discharge passage and attracted by the electromagnetic force of the solenoid; a movable member which moves with the armature to open or close the discharge passage; and a spring which urges the armature and the movable member in a direction to close the discharge passage.

The hole providing the discharge passage in the housing includes: a first hole in which the spring is arranged; and a second hole located on a downstream of the first hole.

The discharge passage is partially provided by a narrow part which is disposed to communicate between the first hole and the second hole through a narrow passage smaller in diameter than the first hole and the second hole.

In one embodiment of the present invention, the narrow passage of the narrow part may have a diameter D perpendicular to a flow direction and a length L along the flow direction, and defines a ratio L/D equal to or smaller than 4.5.

In one embodiment of the present invention, the narrow part may extend, along a flow direction, only in an area adjacent to one end of the spring.

In one embodiment of the present invention, the narrow part may be disposed so that both an upstream end and a downstream end of the narrow part are located between the shoulder end and the first end, or both an upstream end and a downstream end of the narrow part are located between the shoulder end and the second end.

In alternative embodiments, the narrow part can be prepared in a housing or a stopper.

According to one of embodiments, it is possible to shorten the length of the narrow part sufficiently. As a result, adverse effect caused by the length of the narrow part can be suppressed. For example, pressure pulsation in the upstream of the narrow part in the discharge passage can be suppressed. Therefore, it is possible to suppress variation in the closing speed of the armature, and to accurately control injection quantity.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Embodiments of the present invention are described in detail referring to the attached drawings. In the following description and drawings, the same reference number or symbol is given to a component or part which is the same or similar to one that already described in the preceding embodiments. The preceding description may be referenced for the component or part denoted by the same reference number or symbol. Hereinafter, differences from the preceding embodiments are mainly explained in each embodiment. Other configurations are similar to or the same as that of the preceding embodiments, therefore, unless it is apparent, it is possible to achieve similar or the same functions and advantages as described in the preceding embodiments.

First Embodiment

Figure 1:
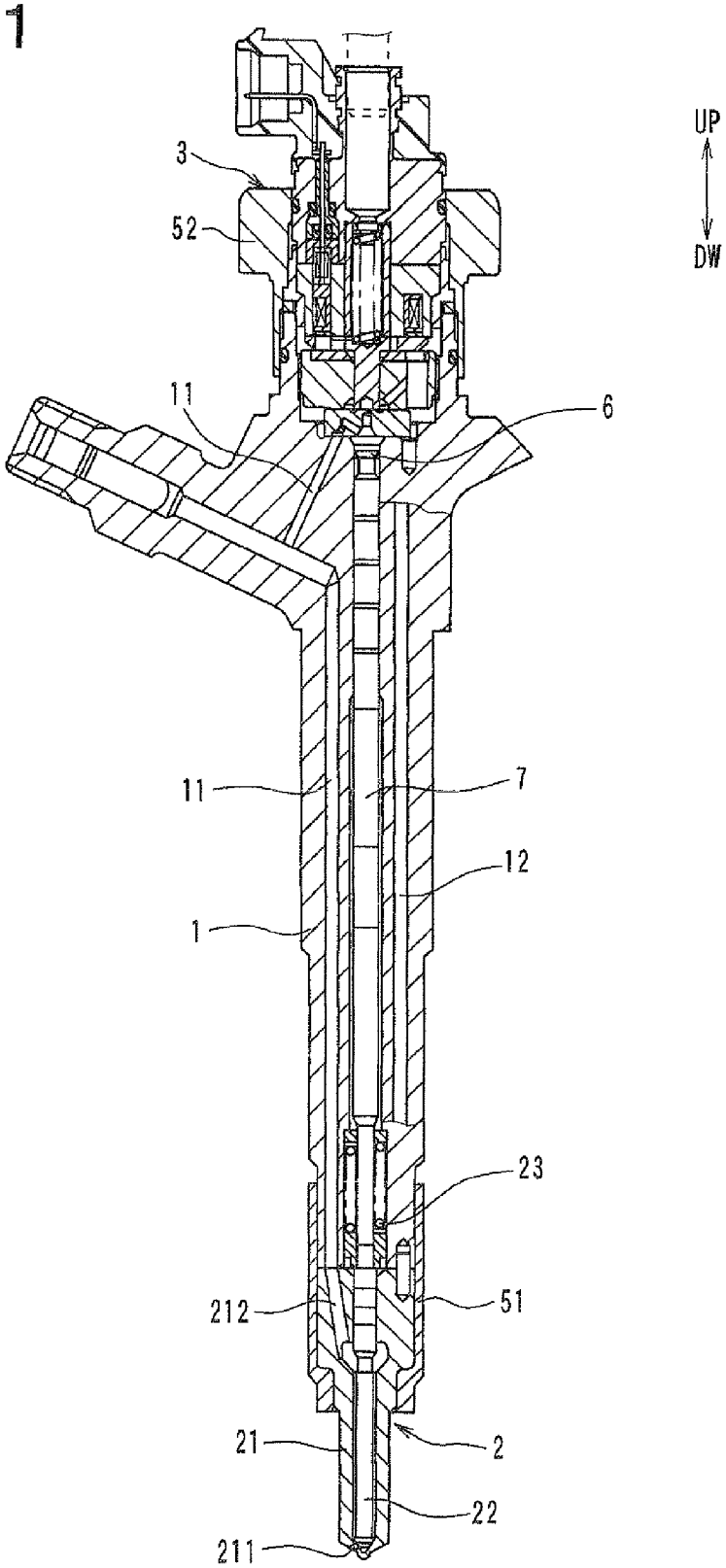
FIG. 1 is a sectional view showing a fuel injection valve according to a first embodiment of the present invention.
Figure 2:
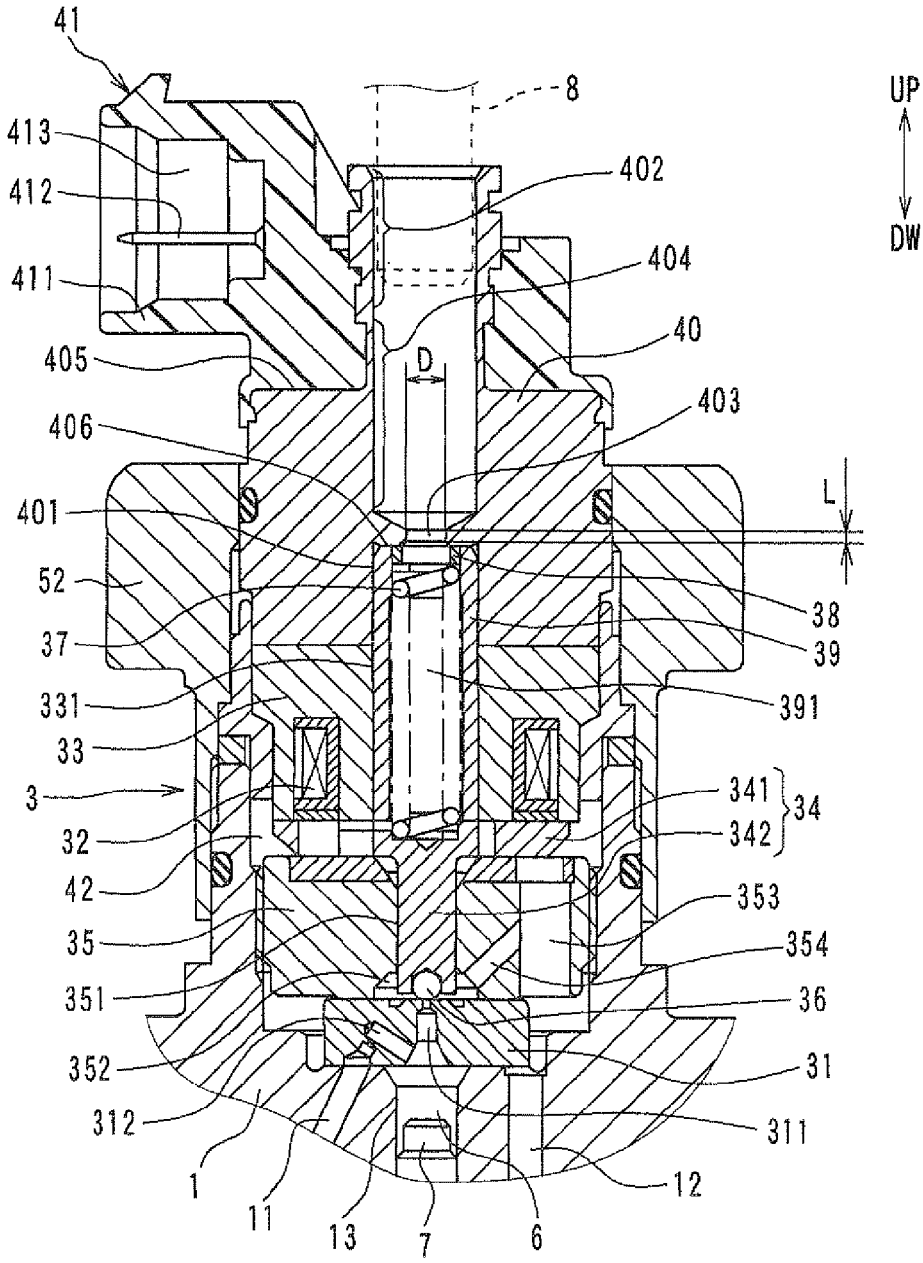
FIG. 2 is an enlarged sectional view showing the fuel injection valve shown in FIG. 1.

FIG. 1 is a sectional view showing a fuel injection valve according to a first embodiment of the present invention. FIG. 2 shows an enlarged view of the fuel injection valve corresponding to an upper part in FIG. 1. In the drawings, an arrow symbol with UP and DW indicates a vertical direction of the fuel injection valve when it is mounted on the engine.

The fuel injection valve is mounted on a cylinder head of an internal combustion engine, e.g., a diesel engine. The fuel injection valve is connected to a common rail for being supplied pressurized fuel and an electronic control unit. The fuel injection valve injects fuel supplied from the common rail into a cylinder of the engine.

As shown in FIG. 1, the fuel injection valve is formed in a stick shape which can be characterized by a first end on a lower side and a second end on an upper side. A holder body 1 provides a main part of the fuel injection valve. The holder body 1 is formed in a cylindrical shape having a branch protrusion to be connected with the common rail. A nozzle 2 is arranged on an end of the holder body 1 at a side close to the first end of the fuel injection valve. On the other hand, an electromagnetic valve 3 is arranged on the other end of the holder body 1 which is located on a side close to the second end of the fuel injection valve. The holder body 1 and the nozzle 2 are tightly connected by a first retaining nut 51. The holder body 1 and the electromagnetic valve 3 are tightly connected by a second retaining nut 52.

A cylindrical command piston 7 is inserted in the holder body 1 in a slidable manner. The command piston 7 pushes and urges the needle 2 in a closing direction by receiving the pressure in the control chamber 6. The holder body 1 is formed with a high pressure fuel passage 11 in which high pressure fuel supplied from the common-rail flows. High pressure fuel supplied from the common-rail is introduced to the control chamber 6 through the high pressure fuel passage 11. The holder body 1 is also formed with a low pressure fuel passage 12 in which low pressure fuel such as leak fuel flows.

The nozzle 2 includes a nozzle body 21, a needle 22 and a nozzle spring 23. The nozzle body 21 is formed with at least one injection hole 211 for injecting a fuel into a cylinder of the engine. The needle 22 is supported on the nozzle body 21 in a slidable manner and is capable of closing and opening the injection hole 211. The nozzle spring 23 pushes and urges the needle 22 in a closing direction so that the needle 22 closes the injection hole 211. The nozzle spring 23 is arranged in the holder body 1. A chamber where the nozzle spring 23 is arranged is communicated with the low pressure fuel passage 12.

The fuel supplied from the common rail is led to an inside of the injection hole 211 through the high pressure fuel passage 11 formed in the holder body 1 and a high pressure fuel passage 212 formed in the nozzle body 21. Pressure of fuel acts on the needle 22, and, thereby, pushes the needle 22 in a direction to open the injection hole 211. However, the needle 22 is also pushed in the closing direction by a closing force. The closing force is applied by the nozzle spring 23 and the command piston 7. In addition, the closing force is variable. When the closing force prevail an opening force generated by high pressure fuel introduced around the needle 22, the needle 22 closes the injection hole 211. When the opening force prevail the closing force, the needle 22 opens the injection hole 211.

As shown in FIG. 2, a piston guide bore 13 in which the command piston 7 is inserted is formed in the holder body 1. An upper part of the piston guide bore 13 provides the control chamber 6. Therefore, pressure in the control chamber 6 acts on the command piston 7.

The electromagnetic valve 3 includes a control chamber plate 31, a coil 32, a stator 33, an armature 34, a guide plate 35, a movable member 36 for a control valve, a spring 37, a shim plate 38, a stopper 39, a housing 40, and a connector 41. The control chamber plate 31 is disposed on the holder body 1. The control chamber plate 31 is formed with a discharging port 311 for discharging fuel from the control chamber 6. The coil 32 generates a magnetic field when being energized. The stator 33 is magnetized with the coil 32 and generates electromagnetic force. The armature 34 is attracted by the electromagnetic force generated on the stator 33. The guide plate 35 holds the armature 34 in a slidable manner. The movable member 36 is joined to the armature 34, and is capable of opening or closing the discharging port 311. The spring 37 pushes and urges the armature 34 in a closing direction to close the discharging port 311 by the movable member 36. The shim plate 38 is formed in a ring shape and is inserted between a seat surface and the spring 37 to adjust an initial set bad of the spring 37. The stopper 39 is made of magnetic material and restricts a movable range of the armature 34 when the armature 34 is attracted by electromagnetic force. The housing 40 is disposed next to or adjacent to the stator 33. The connector member 41 is provided to be connected with another one of paired connectors to supply electric power to the coil 32. The armature 42 is disposed in an armature accommodating chamber 42 defined among components including the coil 32, the stator 33, the guide plate 35, and the holder body 1. The coil 32, the stator 33, and the stopper 39 provide a solenoid. Therefore, the housing 40 is disposed between the solenoid and the second end of the fuel injection valve.

The control chamber plate 31 is formed in a circular plate shape. The control chamber plate 31 is disposed on the holder body 1 to cover an end opening of the piston guide bore 13. The control chamber plate 31 and the holder body 1 cooperatively define the control chamber 6. The control chamber plate 31 is formed with the discharging hole 311 and an introducing hole 312. The introducing hole 312 introduces high pressure fuel into the control chamber 6.

The armature 34 includes a magnetic path part 341 formed in a shape which may be called as a ring shape or a propeller shape. The magnetic path part 341 is disposed in the armature accommodating chamber 42 so that the magnetic path part 341 is placed below a bottom surface of the coil 32 and the stator 33 to face both an outer bottom pole and an inner bottom pole of the stator 33. The armature 34 includes a stem part 342 formed in a columnar shape. The stem part 342 is extended toward the control chamber plate 31 from a center of the magnetic path part 341.

The movable member 36 is joined to a distal end part, i.e. a bottom end, of the stem part 342. In other words, the movable member 36 and the armature 34 are integrally formed. The movable member 36 is capable of being separated from the control-chamber plate 31 to open the discharging port 311 and being contacted on the control-chamber plate 31 to close the discharging port 311.

A stem part guide bore 351 is formed on a radial center of the guide plate 35. The stem part 342 is inserted in the stem part guide bore 351 in a slidable manner. A valve chamber 352 is formed on a bottom of the guide plate 35 at a bottom of the stern part guide bore 351. The valve chamber 352 receives fuel discharged from the discharging port 311. A low pressure communicating hole 353 is formed on the guide plate 35 at a position outwardly offset from the radial center. The low-pressure communicating hole 353 provides a fluid communication between the armature accommodating chamber 42 and the low pressure fuel passage 12. The guide plate 35 is further formed with a sub-low-pressure-communicating hole 354 for communicating the valve chamber 352 and the low-pressure-communicating hole 353.

The housing 40 is made of non-magnetic material, e.g., stainless steel. The housing 40 is disposed next to or closely adjacent to the stator 33 in a side-by-side manner. The housing 40 is disposed next to the stator 33 on a side directed to the second end of the fuel injection valve. The housing 40 is located on a side of the stator 33 opposite to the first end of the fuel injection valve. In other words, the housing 40 is disposed between the stator 33 of the solenoid and the second end of the fuel injection valve. That is, the housing 40 is disposed on an upper side of the stator 33 or on a downstream side of the discharge passage.

A through hole is formed on a radial center part of the housing 40 to penetrate the housing 40. The through hole permits discharged fuel flows through in an axial direction of the fuel injection valve. The through hole includes a lower hole 401, an upper hole 402, a housing-communicating hole 403, and an extended hole 404. The lower hole 401 is disposed to provide a part of the through hole relatively close to the first end. In other words, the lower hole 401 is formed on an upstream side in the housing 40. The lower hole 401 has an upstream end which opens on the housing 40 toward the first end. The upper hole 402 is disposed to provide a part of the through hole relatively close to the second end. In other words, the upper hole 402 is formed on a downstream side in the housing 40. The upper hole 402 has a downstream end which opens on the housing 40 toward the second end. The housing-communicating hole 403 is smaller in diameter than both the lower hole 401 and the upper hole 402. The housing-communicating hole 403 is disposed on a downstream side of the lower hole 401, and is formed continuously from the lower hole 401. The extended hole 404 is larger in diameter than the housing-communicating hole 403 and is disposed to communicate between the upper hole 402 and the housing-communicating hole 403.

The upper hole 401 may also be referred to as a first hole or an upstream hole. The upper hole 402 and the extended hole 404 may also be referred to as a second hole or a downstream hole. The housing-communicating hole 403 may also be referred to as a narrow part or a restrictor. The fuel injection valve defines a downstream side part of the discharge passage extending in a downstream side from the armature accommodating chamber 42. The narrow part 403 provides the narrowest passage in the downstream side part of the discharge passage.

The diameter of the extended hole 404 is equal to the diameter of the upper hole 402 in order to process the extended hole 404 easily. Although there is no visible boundary between the upper hole 402 and the extended hole 404, the upper hole 402 and its length can be recognized and defined by an area which is necessary to insert and fix the return pipe 8. That is, the length of the upper hole 402 includes an insertion depth of the return pipe 8 and a predetermined margin. The extended hole 404 extends over both sides of the shoulder end 405.

The housing 40 is formed in a cylindrical shape having a small outer diameter part, a large outer diameter part and a step part. The housing 40 provides a shoulder end 405 on which the connector 411 is attached. The shoulder end 405 is the step part and provides an annular surface radially extending perpendicular to an axial direction of the fuel injection valve.

The connector member 41 is provided with the connector 411 and the terminal 412. The connector 411 may be also referred to as a connector housing. The connector 411 is made of resin and is formed integrally with the housing 40 by a molding process. The connector 411 is one of a pair of connectors, and provides an engaging portion 413 to which the other one of the pair is engaged. The connector member 41 includes terminals 412 inserted in the connector 411. Each terminal 412 has one end exposed to the engaging portion 413 and the other end connected to the coil 32.

A stator hole 331 penetrating the stator 33 in the axial direction of the fuel injection valve is formed on a radial center part of the stator 33. The stopper 39 is inserted in the stator hole 331 and the lower hole 401. The stopper 39 extends over both the stator hole 331 and the lower hole 401.

A solenoid passage 391 penetrating the stopper 39 in the axial direction of the fuel injection valve is formed on a radial center part of the stopper 39. One end, an upstream end, of the solenoid passage 391 is communicated with the armature accommodating chamber 42. The other end, a downstream end, of the solenoid passage 391 is communicated with the housing-communicating hole 403. The spring 37 and the shim 38 are inserted in the solenoid passage 391. The shim 38 is disposed to come in contact with a bottom 406 of the lower hole 401, i.e., the most downstream side of the lower hole 401.

A lower end of the stopper 39 is slightly projected from the stator 33. When the armature 34 is attracted by electromagnetic force, the armature 34 comes in contact with the lower end of the stopper 39. Therefore, the lower end serves to restrict a movable range of the armature 34 when the armature 34 is attracted by electromagnetic force. An upper end of the stopper 39 is disposed to come in contact with a bottom 406 of the lower hole 401.

The upstream end of the housing-communicating hole 403 is located in a lower side area from the shoulder end 405. The lower side area may be also referred to as a first-end-side area from the shoulder end 405, since a distance from the lower side area to the first end is closer than a distance from an upper side area to the first end. In other words, the upstream end of the housing-communicating hole 403 is located between the shoulder end 405 and the first end. Further, the upstream end of the housing-communicating hole 403 is located closer to the upstream end opening of the lower hole 401 than the shoulder end 405. In addition, the extended hole 404 has an upstream end located in the lower side area from the shoulder end 405 close to the first end. Therefore, the upstream end of the extended hole 404 is located between the shoulder end 405 and the first end. In other words, the extended hole 404 is formed to be extended from the upper hole 402 to the lower side area beyond the shoulder end 405. A downstream end of the housing-communicating hole 403 is located in the lower side area, i.e. the first-end-side area, from the shoulder end 405. Therefore, both the upstream end and the downstream end of the housing-communicating hole 403, i.e., the narrow part, are disposed between the shoulder end 405 and the first end. The housing-communicating hole 403, i.e., the narrow part, is disposed adjacent to one end of the spring 37 which is the closer one to the second end of the fuel injection valve. In other words, the housing-communicating hole 403 is formed to provide a spring seat for the spring 37 and extends, along a flow direction, only in an area adjacent to one end of the spring 37.

A ratio L/D of the housing-communicating hole 403 is approximately equal to 0.4, where L is a length along a flow direction, and D is a diameter perpendicular to the flow direction.

The valve chamber 352, the sub-low-pressure-communicating hole 354, the low-pressure-communicating hole 353, the armature accommodating chamber 42, the solenoid passage 391, the lower hole 401, the upper hole 402, the housing-communicating hole 403, and the extended hole 404 provide the discharge passage.

An operation of the fuel injection valve is explained below. When the coil 32 is energized by supplying drive current, the armature 34 and the movable member 36 is attracted toward the stator 33 to open the discharging port 311. Then, fuel in the control chamber 6 is discharged from the discharging port 311 to the fuel tank through the discharge passage and the return pipe 8.

As fuel is discharged from the control chamber 6, pressure in the control chamber 6 is decreased and force acting on the needle 22 via the command piston 7 in the closing direction is also decreased. Therefore, the needle 22 is lifted in the opening direction by fuel pressure directly acting on the needle 22 and opens the injection hole 211. Fuel is injected into the cylinder of the engine through the injection hole 211.

Then, the coil 32 is de-energized by stopping drive current. Since the magnetic force of the stator 33 attracting the armature 34 disappears, the armature 34 and the movable member 36 are pushed and moved by the spring 37 to close the discharging port 311.

Then, pressure in the control chamber 6 is increased by high pressure fuel supplied through the introducing hole 312. As pressure in the control chamber 6 increases, force pushing the needle 22 in the closing direction through the command piston 7 is increased. Therefore, the needle 22 moves to close the injection hole 211, and stops a fuel injection.

As mentioned above, the narrow passage, i.e., the housing-communicating hole 403 adversely generates pressure pulsations in the upstream of the housing-communicating hole 403 in the discharge passage. If the pressure pulsations increased excessively, the closing speed of the armature 34 might be varied greatly by the pressure pulsations, and it is difficult to control injection quantity accurately.

However, this embodiment shortens the length L of the housing-communicating hole 403 by forming the housing-communicating hole 403 and the extended hole 404 as explained above. Therefore, it is possible to suppress effect caused by a length of the narrow part 403, and to suppress pressure pulsations in the discharge passage. Therefore, it is possible to accurately control injection quantity, since a variation of closing speed of the armature 34 caused by the pulsations can be suppressed.

Figure 3:
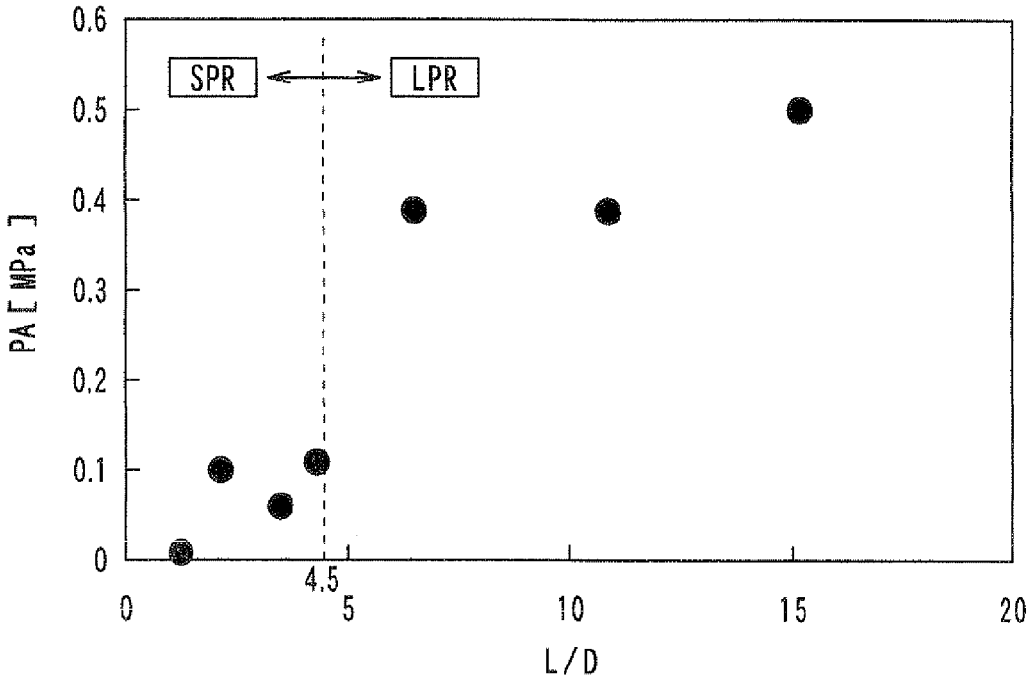
FIG. 3 is a graph showing a relationship between a ratio L/D and a pulsation amplitude PA.

FIG. 3 shows a graph showing the ratio of L/D on the horizontal axis and an amplitude PA of pressure pulsations on the vertical axis. The pressure pulsation is observed in an upstream side of the housing-communicating hole 403 in the discharge passage. In detail, the pressure pulsations shown in the drawing may be reproduced by observing pressure in a vicinity of the armature accommodating chamber 42. The amplitude PA is a difference between a peak pressure of pulsation of discharged fuel and an average pressure of discharged fuel. The pressure pulsation is observed while operating the fuel injection valve under conditions where high pressure fuel supplied to the control chamber 6 is regulated at 200 MPa, and the diameter D of the housing-communicating hole 403 is fixed 2.3 mm in diameter.

According to the graph in FIG. 3, it is apparent that the amplitude PA of pressure pulsation can be suppressed by reducing the ratio L/D. In addition, according to the graph in FIG. 3, it is understood that the amplitude PA of pressure pulsation can be significantly suppressed by setting the ratio L/D equal to or smaller than 4.5.

As mentioned above, the ratio L/D in this embodiment is set less than 0.5. This value is determined to suppress pressure pulsations even if operating condition is changed. Alternatively, the ratio L/D may be set smaller than 1.0. The length L may be shortened to a certain length which can provide sufficient strength as a spring seat for receiving and withstanding against a load of the spring 37. In the drawing, SPR shows a range in which the pulsation PA is sufficiently suppressed, and LPR shows a range in which the pulsation PA is still large. The length L and the diameter D is preferably set to satisfy $L \ll D$. The location of the housing-communicating hole 403 is determined to sufficiently enlarge capacity of the second hole 402, 404.

Therefore, it is possible to suppress variation in the closing speed of the armature, and to accurately control injection quantity.

Second Embodiment

Figure 4:
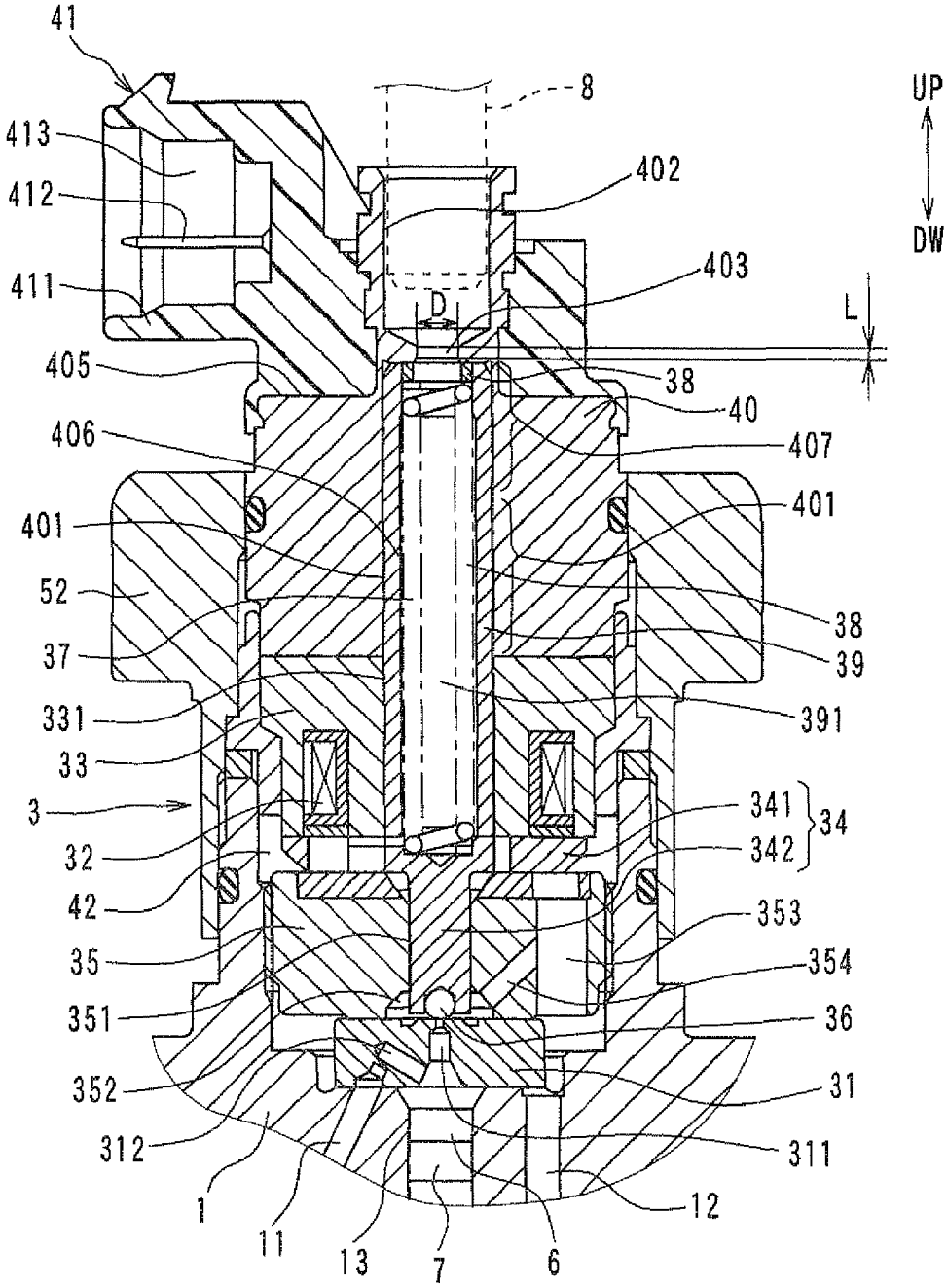
FIG. 4 is an enlarged sectional view showing a fuel injection valve according to a second embodiment of the present invention.

A second embodiment is described by referring to FIG. 4 which shows an enlarged sectional view of a fuel injection valve.

Only a part of the housing 40 in this embodiment is different from the preceding embodiment. The remaining components are the same or similar to those in the preceding embodiment. Therefore, differences are mainly explained below.

As shown in FIG. 4, the housing 40 of this embodiment has no extended hole 404. Alternatively, an extended hole 407 is formed in the housing 40 instead of the extended hole 404. The extended hole 407 provides a fluid communication between the lower hole 401 and the housing-communicating hole 403. The housing-communicating hole 403 provides a narrow passage of a narrow part in the discharge passage. The extended hole 407 provides a part of the discharge passage. The extended hole 407 has a diameter larger than that of the housing-communicating hole 403. The diameter of the extended hole 407 is equal to the diameter of the lower hole 401 in order to process the extended hole 407 easily.

The lower hole 401 and the extended hole 407 may also be referred to as the first hole or an upstream hole. The upper hole 402 may also be referred to as the second hole or a downstream hole. The extended hole 407 extends over both sides of the shoulder end 405. The stopper 39 also extends over both sides of the shoulder end 405.

The downstream end of the communicating hole 403 is located in the upper side area which is located above the shoulder end 405 and is close to the second end. In other words, the downstream end of the housing-communicating hole 403 is located between the shoulder end 405 and the second end. In addition, the extended hole 407 has a downstream end located in the upper side area. Therefore, the downstream end of the extended hole 407 is located between the shoulder end 405 and the second end. In other words, the extended hole 407 is formed to be extended from the lower hole 401 to the upper side area beyond the shoulder end 405. A downstream end of the housing-communicating hole 403 is located in the upper side area, i.e. a second-end-side area, from the shoulder end 405. Therefore, both the upstream end and the downstream end of the housing-communicating hole 403, i.e., the narrow part, are disposed between the shoulder end 405 and the second end. As a result, it is possible to shorten the housing-communicating hole 403 in a length along a flow direction. A ratio L/D of the housing-communicating hole 403 is equal to or smaller than 4.5.

According to the embodiment, it is possible to suppress adverse effect of a length of the narrow part 403, and to suppress pressure pulsations in the discharge passage. Therefore, it is possible to accurately control injection quantity, since a variation of closing speed of the armature 34 caused by the pulsations can be suppressed.

Third Embodiment

Figure 5:
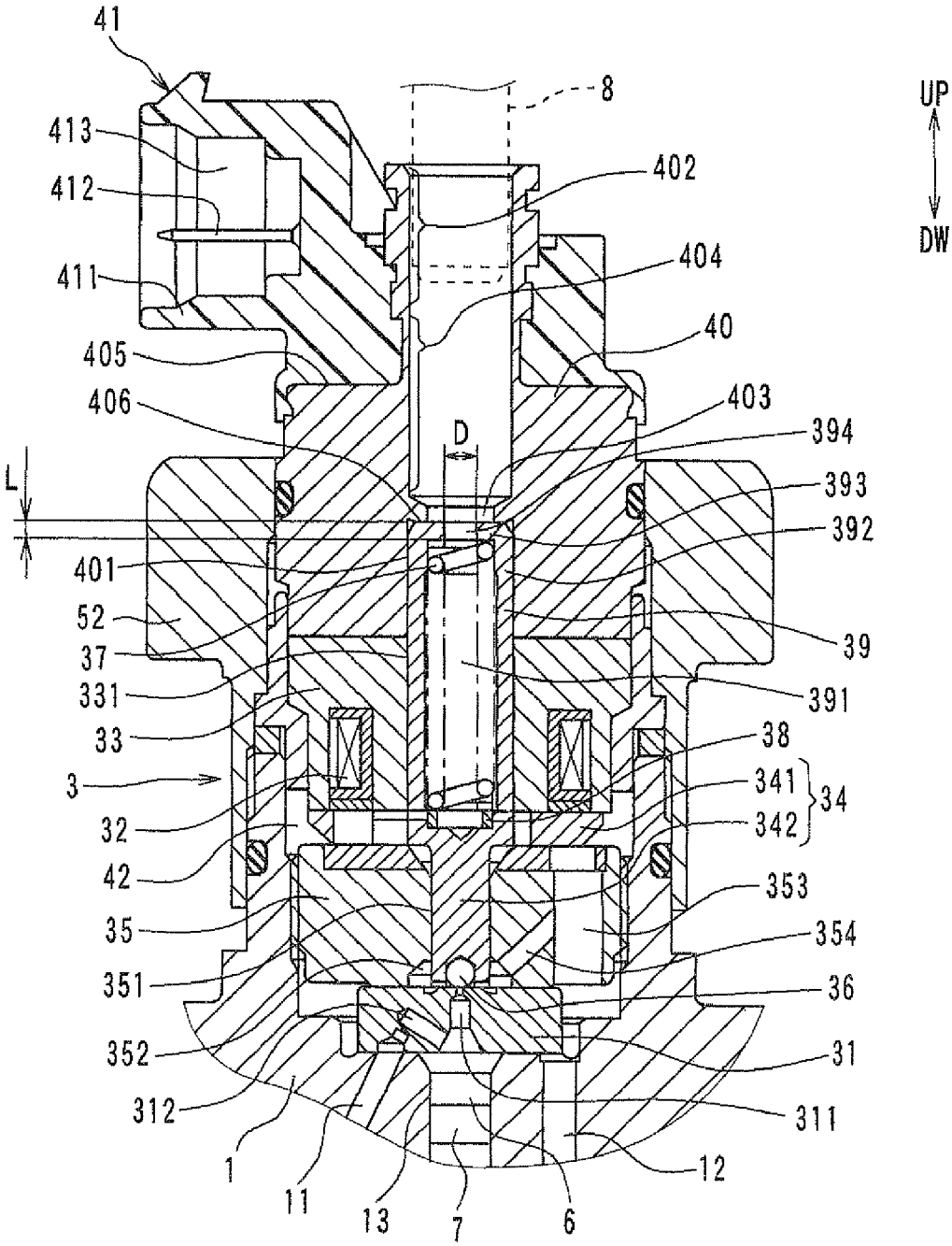
FIG. 5 is an enlarged sectional view showing a fuel injection valve according to a third embodiment of the present invention.

A third embodiment is described by referring to FIG. 5 which shows an enlarged sectional view of a fuel injection valve.

Only a part of the stopper 39 and the housing 40 in this embodiment is different from the preceding embodiments. The remaining components are the same or similar to those in the preceding embodiments. Therefore, differences are mainly explained below.

As shown in FIG. 5, the stopper 39 of this embodiment is formed in a cylindrical shape which has a cylindrical wall 392 and a bottom wall 393. The stopper 39 is inserted in the stator hole 331 and the lower hole 401. The bottom wall 393 is placed to come in contact with a bottom 406 of the lower hole 401. The spring 37 and the shim plate 38 are inserted in the solenoid passage 391. The spring 37 is disposed to come in contact with the bottom wall 393 of the stopper 39.

The stopper 39 defines a solenoid passage 391 there inside. The spring 37 is arranged in the solenoid passage 391. The solenoid passage 391 is formed in the cylindrical wall 392 and provides a part of the discharge passage. The bottom wall 393 is formed with a stopper-communicating hole 394 which penetrates the bottom wall 393 and provides a part of the discharge passage by communicating the housing-communicating hole 403 and the solenoid passage 391. The stopper-communicating hole 394 is smaller in diameter than the housing-communicating hole 403. The stopper-communicating hole 394 may also be referred to as the narrow part of the restrictor. The stopper-communicating hole 394, i.e., the narrow part, is disposed adjacent to one end of the spring 37 which is the closer one to the second end of the fuel injection valve. In other words, the stopper-communicating hole 394 is formed to provide a part of spring seat for the spring 37 and extends, along a flow direction, only in an area adjacent to one end of the spring 37.

In this embodiment, since the stopper-communicating hole 394 for the narrow part in the discharge passage is formed on the bottom wall 393 of the stopper 39 which is a separated component from the housing 40, it is possible to form the restrictor independently from the housing 40. Therefore, it is possible to shorten a length of the stopper-communicating hole 394. It is possible to reduce a ratio L/D of the stopper-communicating hole 394, where L is a length along a flow direction, and D is a diameter perpendicular to the flow direction. The ratio L/D of the stopper-communicating hole 394 is equal to or smaller than 4.5.

According to the embodiment, it is possible to suppress an adverse effect of a length of the narrow part 394, and to suppress pressure pulsations in the discharge passage. Therefore, it is possible to accurately control injection quantity, since a variation of closing speed of the armature 34 caused by the pulsations can be suppressed.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A fuel injection valve having a first end and a second end axially spaced from each other, comprising:

a valve mechanism disposed on the first end, the valve mechanism including a nozzle defining an injection hole for injecting fuel and a needle for opening or closing the injection hole;

a control chamber in which high-pressure fuel is introduced; and an electromagnetic valve that opens or closes a discharge passage for discharging fuel in the control chamber to a low pressure part, the electromagnetic valve being capable of changing pressure in the control chamber to actuate the needle, wherein the electromagnetic valve includes:

a solenoid that defines a solenoid passage for providing a part of the discharge passage and generates electromagnetic force when being energized;

a connector that receives a terminal connected to the solenoid;

a housing that is disposed between the solenoid and the second end, defines a hole for providing a part of the discharge passage, and provides a shoulder end on which the connector is attached and which radially extends perpendicular to an axial direction of the fuel injection valve;

an armature that is arranged in the discharge passage and attracted by the electromagnetic force of the solenoid;

a movable member that moves with the armature to open or close the discharge passage; and a spring that urges the armature and the movable member in a direction to close the discharge passage, the hole providing the discharge passage in the housing includes:

a first hole in which the spring is arranged; and a second hole located downstream of the first hole, the discharge passage is partially provided by a narrow part that is disposed to communicate between the first hole and the second hole through a narrow passage smaller in diameter than the first hole and the second hole, and the narrow passage of the narrow part has a diameter D perpendicular to a flow direction and a length L along the flow direction, and defines a ratio L/D equal to or smaller than 4.5.

* * * * *

UNITED STATES PATENT AND TRADEMARK OFFICE

CERTIFICATE OF CORRECTION

PATENT NO. : 8,382,007 B2
APPLICATION NO. : 12/842137
DATED : February 26, 2013
INVENTOR(S) : Sugawara et al.

It is certified that error appears in the above-identified patent and that said Letters Patent is hereby corrected as shown below:

Title Page, Item (75) should read:

--(75) Inventors: Satoshi Sugawara, Kariya (JP);
Tomonori Kamiya, Ichinomiya (JP)--.

Signed and Sealed this
Twenty-fifth Day of June, 2013

Teresa Stanek Rea
*Acting Director of the United States Patent and Trademark Office*